US005101791A

United States Patent [19]

Kuettner et al.

[11] Patent Number: 5,101,791

[45] Date of Patent: Apr. 7, 1992

[54] METHOD AND APPARATUS FOR REGULATING AND CONTROLLING AN INTERNAL COMBUSTION ENGINE

[75] Inventors: Thomas Kuettner, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 628,230

[22] Filed: Dec. 14, 1990

[30] Foreign Application Priority Data

Feb. 23, 1990 [DE] Fed. Rep. of Germany ..... 4005735

[51] Int. Cl.[5] ..... F02M 7/00

[52] U.S. Cl. ..... 123/436

[58] Field of Search ..... 123/436, 419; 364/431.08

[56] References Cited

U.S. PATENT DOCUMENTS 4,688,535 8/1987 Kutner et al. ..... 123/436
4,915,079 4/1990 Holmes ..... 123/419
4,977,508 12/1990 Tanaka et al. ..... 123/436
5,001,645 3/1991 Williams et al. ..... 364/431.08
5,010,866 4/1991 Ohata ..... 123/436
5,016,593 5/1991 Takaoka ..... 123/436

FOREIGN PATENT DOCUMENTS 3540313 5/1986 Fed. Rep. of Germany ..... 123/436
3540811 5/1987 Fed. Rep. of Germany ..... 123/436

*Primary Examiner*—Raymond A. Nelli
*Attorney, Agent, or Firm*—Kenyon & Kenyon

[57] ABSTRACT

A method and apparatus regulate and control the running smoothness of an internal combustion engine. Based on the existing operating conditions, either a running-smoothness regulation or a running-smoothness control is performed. If the vibrational frequency of the engine or the system deviation thereof reaches a threshold value, or if the absolute value of the system deviation is greater than the threshold value, then the running-smoothness regulation is ceased.

21 Claims, 5 Drawing Sheets

RUNNING SMOOTHNESS

RUNNING SMOOTHNESS

METHOD AND APPARATUS FOR REGULATING AND CONTROLLING AN INTERNAL COMBUSTION ENGINE

FIELD OF THE INVENTION

The present invention relates to methods and apparatus for regulating and controlling the operation of internal combustion engines and, in particular, to methods and apparatus for regulating and controlling internal combustion engines for operational smoothness.

BACKGROUND INFORMATION

A system for regulating and controlling the smooth running of an internal combustion engine is shown in U.S Pat. No. 4,688,535. The system attempts to limit vibrations of the vehicle in the lower speed range, particularly during idling. These vibrations are often described as "shaking", and are typically caused, for example, by limitations in manufacturing tolerances. The limitations in manufacturing tolerances can cause different quantities of fuel to be metered to the different cylinders of the engine. The system attempts to eliminate these vibrations with an automatic regulating system, which regulates the metering of fuel to achieve the smoothest possible running conditions for each cylinder.

One problem with this system, however, is that vibrations occur in certain operating states, particularly in systems with a dual-mass flywheel, which are not equalized by regulating the metering of fuel. Indeed, in some instances, vibrations can be intensified by attempts to regulate the metering of fuel to achieve smooth running conditions.

It is an object of the present invention, therefore, to overcome the problems encountered in prior art methods and apparatus for eliminating vehicle vibrations.

SUMMARY OF THE INVENTION

The present invention is directed to a method for regulating and controlling the smooth operation of an internal combustion engine. The method comprises the following steps: performing a running-smoothness regulation by regulating the flow of fuel to the cylinders of the engine to achieve smooth engine operating conditions; sensing the vibrational frequency of the engine and generating output signals indicative thereof; and comparing the output signals to a threshold value, and if the output signals exceed the threshold value, ceasing the running-smoothness regulation.

A method of the present invention preferably further comprises the steps of continuing to generate the output signals and to compare the output signals to the threshold value upon ceasing the running-smoothness regulation, and if the output signals drop below the threshold value, initiating a waiting period, and upon the expiration of the waiting period, initiating the running-smoothness regulation.

In one method of the present invention, the vibrational frequency values are converted into corresponding system deviation values and, thus, the output signals generated are indicative thereof. The system deviation values are preferably detected by means of a frequency counter. The frequency counter is increased in response to a system deviation value simultaneously changing its sign and exceeding a threshold value.

A method of the present invention also further comprises the steps of initiating a waiting time period and continuing to generate the output signals and to compare the output signals to the threshold value upon ceasing the running-smoothness regulation; and if upon the expiration of the waiting time period, the output signals continue to exceed the threshold value, performing an additional step selected from the group including a) increasing the engine idling speed, b) setting the integrator of a regulating unit equal to zero, and c) cancelling the stored correction fuel quantities of a regulating unit. The engine idling speed is preferably increased within the range of 50 to 100 revolutions per minute.

A method of the present invention also further comprises the steps of determining a correction fuel quantity for each cylinder of the engine during the running-smoothness regulation; storing the correction fuel quantities; and adding the correction fuel quantities to corresponding basic fuel quantities for the respective cylinders to determine new basic fuel quantities therefor and, in turn, controlling the flow of fuel to the respective cylinders in accordance with the respective new basic fuel quantities.

The present invention is also directed to an apparatus for regulating and controlling the smooth operation of an internal combustion engine. The apparatus comprises at least one regulating unit for performing a running-smoothness regulation by regulating the flow of fuel to the cylinders of the internal combustion engine to achieve smooth engine operating conditions. The apparatus also comprises means for sensing the vibrational frequency of the engine and generating output signals indicative thereof. A control unit of the apparatus is coupled to the regulating unit and to the means for sensing for receiving the output signals therefrom. The control unit is adapted to compare the output signals to a threshold value, and if the output signals exceed the threshold value, to control the regulating unit to cease the running-smoothness regulation.

Preferably, the means for sensing is adapted to continue to generate output signals and the control unit is adapted to continue to compare the output signals to the threshold value upon ceasing the running-smoothness regulation. If the output signals drop below the threshold value, the control unit is further adapted to initiate a waiting period and upon expiration of the waiting period to, in turn, control the regulating unit to initiate the running-smoothness regulation.

In an apparatus of the present invention, the control unit is also adapted to convert the output signals transmitted by the means for sensing into corresponding signals indicative of system deviation values. The system deviation values are based on the difference between the instantaneous vibrational frequency of the engine sensed by the means for sensing and a setpoint value. The setpoint value is preferably equal to the vibrational frequency of the crankshaft of the engine. The control unit also preferably includes a frequency counter adapted to generate the system deviation values. The frequency counter is preferably increased in response to a system deviation value simultaneously changing its sign and exceeding a threshold value.

In an apparatus of the present invention, the first means is adapted to continue to generate output signals and the control unit is adapted to initiate a waiting time period and to continue to compare the output signals to the threshold value upon ceasing the running-smoothness regulation. If upon the expiration of the waiting time period the output signals continue to exceed the threshold value, the control unit is further adapted to cause an increase in the engine idling speed. The control unit preferably causes the engine idling speed to increase within the range of 50 to 100 revolutions per minute.

In an apparatus of the present invention, the regulating unit is adapted to determine a correction fuel quantity for at least one cylinder of the engine and to transmit signals to the control unit indicative thereof. The control unit is further adapted to store the signals in response thereto and, in turn, add the value of each correction fuel quantity to a basic fuel quantity for a respective cylinder to determine a new fuel quantity therefor. The control unit is further adapted to control the flow of fuel to a respective cylinder in accordance with the new fuel quantity therefor.

Thus, one advantage of the method and apparatus of the present invention, is that because the running-smoothness regulation is ceased upon the vibrational frequency of the engine exceeding a threshold value, the vibrations do not become intensified due to any continuing action of the regulation. Another advantage of the method and apparatus of the present invention, is that once the running-smoothness regulation is ceased, other steps can be taken to eradicate the vibrations preventing the smooth operation of the internal combustion engine. For example, the engine speed can be increased to change the vibrational frequency thereof.

Other advantages of the method and apparatus of the present invention will become apparent in view of the following detailed description and drawings taken in connection therewith.

DETAILED DESCRIPTION

Figure 1:
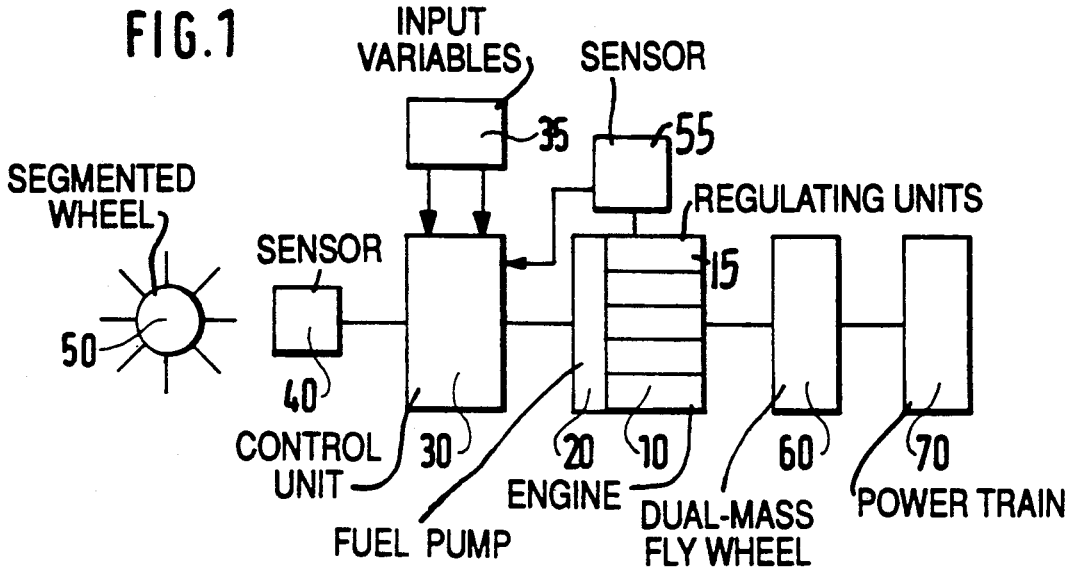
FIG. 1 is a schematic illustration of an apparatus embodying the present invention for regulating and controlling the smooth operation of an internal combustion engine.

In FIG. 1, an apparatus embodying the present invention for regulating and controlling the smooth operation of an internal combustion engine is illustrated. An internal combustion engine indicated generally by the reference numeral 10 includes several cylinders (not shown), which each receive metered fuel from a fuel pump 20. An electronic control unit 30 transmits control signals to the fuel pump 20 to control the operation thereof. The control signals are based on different input variables 35 and output signals transmitted by a sensor 40. A segmented wheel 50 including spaced angular marks thereon, as shown in FIG. 1, is mounted on the crankshaft (not shown) of the engine 10. The sensor 40 detects the pulses caused by the passing angular marks of the rotating segmented wheel 50 and, in turn, transmits output signals indicative thereof to the control unit 30.

The moment of rotation generated by the internal combustion engine 10 is either transferred directly, or by means of a dual-mass flywheel 60, to a power train 70 of the motor vehicle. Based upon the input variables 35, the electronic control unit 30 calculates a basic fuel quantity and a correction fuel quantity for each cylinder, in a manner known to those of ordinary skill in the art. The electronic control unit 30 preferably includes the components described in U.S. Pat. No. 4,688,535, which is expressly incorporated herein by reference.

One problem that can typically occur with internal combustion engines, is that with the same control signal, different quantities of fuel can be metered to different cylinders, or with the same quantity of fuel, different cylinders can produce different moments of rotation. Thus, to avoid irregular running conditions, these differences must be equalized.

This problem is solved in the method and apparatus of the present invention by assigning a regulating unit, indicated typically by the reference numeral 15 in FIG. 1, to each cylinder of the engine 10. It is particularly advantageous when the regulating units 15 include proportional-integral action PI. Based on the pulses generated by the segmented wheel 50 from combustion to combustion, each regulating unit 15 calculates a correction fuel quantity for its respective cylinder. The correction fuel quantities are transmitted to and, in turn, stored in the electronic control unit 30 for each respective cylinder.

While regulating the engine 10 to achieve smooth running conditions ("running-smoothness regulation"), the correction fuel quantities are continuously determined by the regulating units 15 for each respective cylinder and stored in the electronic control unit 30. The correction fuel quantities can assume either positive or negative values. Each correction fuel quantity is then added to (or subtracted from) the basic fuel quantity supplied to the respective cylinder.

During the control of the engine to achieve smooth running conditions ("running-smoothness control"), on the other hand, it is not necessary to calculate new correction fuel quantities for the cylinders. Rather, the stored values are added to (or subtracted from) the corresponding basic fuel quantities for the cylinders by the control unit 30.

Figure 2A:
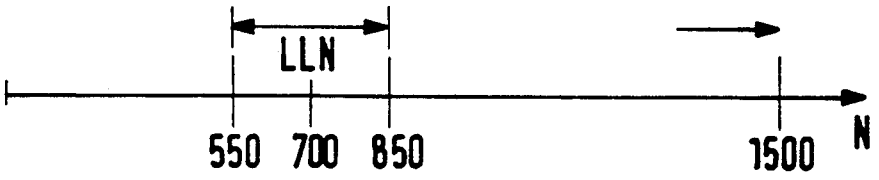
FIG. 2*a* is a graph illustrating the areas of vehicle operation in which the method and apparatus of the present invention regulate the idling conditions of an internal combustion engine.

The running-smoothness regulation is typically only performed during idling operation of the engine 10. Therefore, if the engine 10 is controlled to achieve smooth running conditions other than while idling, the control is performed independently of the fuel metering process. The different operating ranges of the engine 10 are illustrated schematically in FIG. 2*a* and FIG. 2*b*. The running-smoothness regulation is performed only within the idling speed range LLN of the engine 10, as detected by the electronic control unit 30. As shown in FIG. 2*a*, the idling speed range LLN is typically within the range of about 550 to 850 revolutions per minute, and is usually about 700 revolutions per minute. Thus, the running-smoothness regulation is performed only in a speed range of between approximately 550 and 850 revolutions per minute. In the remaining speed ranges, only the running-smoothness control is performed.

Above a critical engine speed, the manufacturing tolerances of an engine typically no longer have an effect on the operational smoothness of the engine. Accordingly, above the critical engine speed, the running-smoothness regulation no longer provides any advantages and, thus, is no longer performed. The critical engine speed is approximately 1,500 revolutions per minute.

Figure 2B:
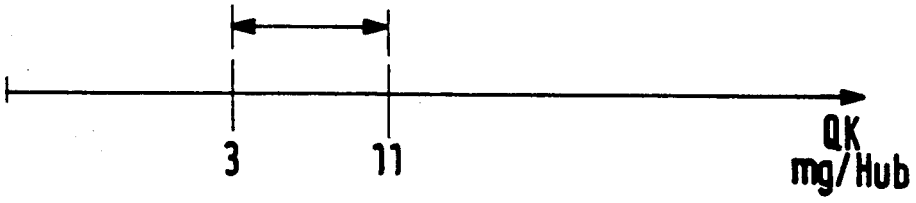
FIG. 2*b* is another graph illustrating the areas of vehicle operation in which the method and apparatus of the present invention regulate the idling conditions of an internal combustion engine.

Other operating characteristic quantities can be evaluated, however, instead of the rotational speed of the engine, to subdivide the ranges within which the running-smoothness regulation and running-smoothness control are respectively activated. One such quantity, for example, is the quantity of fuel injected per piston stroke, as measured by the electronic control unit 30. As shown in FIG. 2*b*, the running-smoothness regulation is activated only when the quantity of fuel injected to each cylinder is within the range of about 3 mg/stroke to 11 mg/stroke.

Thus, the ranges within which the running-smoothness regulation is activated depends on the engine idling speed but, however, can be made dependent on other factors, such as the quantity of fuel being injected to each respective cylinder. Accordingly, since different types of internal combustion engines have different operating characteristics, such as different idling speeds, the ranges can correspondingly deviate from the values set forth above depending upon the characteristics of the particular engine.

Typically, engine vibrations having relatively high amplitudes and/or certain frequencies cannot be equalized by running-smoothness regulation. This is particularly the case when the engine, such as the engine 10, has a dual-mass flywheel 60. A dual-mass flywheel, such as the flywheel 60, typically has different resonant frequencies, or a resonant frequency different than that of the engine 10. If the resonant frequency of the dual-mass flywheel 60 is excited, then the vibrations are typically transmitted throughout the engine 10 and, indeed, the motor vehicle.

A sensor 55 of a type known to those of ordinary skill in the art is coupled to the engine 10 and to the electronic control unit 30. The sensor 55 detects the frequency F of the vibrations of the engine 10 and transmits signals indicative thereof to the control unit 30. If the vibrations have a frequency F, which is either equal to the crankshaft frequency or about 1.5 times the crankshaft frequency, then they can interfere with the running-smoothness regulation. For example, one problem that can occur is that in performing the running-smoothness regulation, the correction fuel quantity may be continuously increased in response to such vibrations. Rather than dampen the vibrations, however, the running-smoothness regulation can cause the vibrations to become intensified. Thus, in accordance with the operation of the method and apparatus of the present invention, in such cases the regulating units 15 are controlled to cease the running-smoothness regulation.

Figure 3:
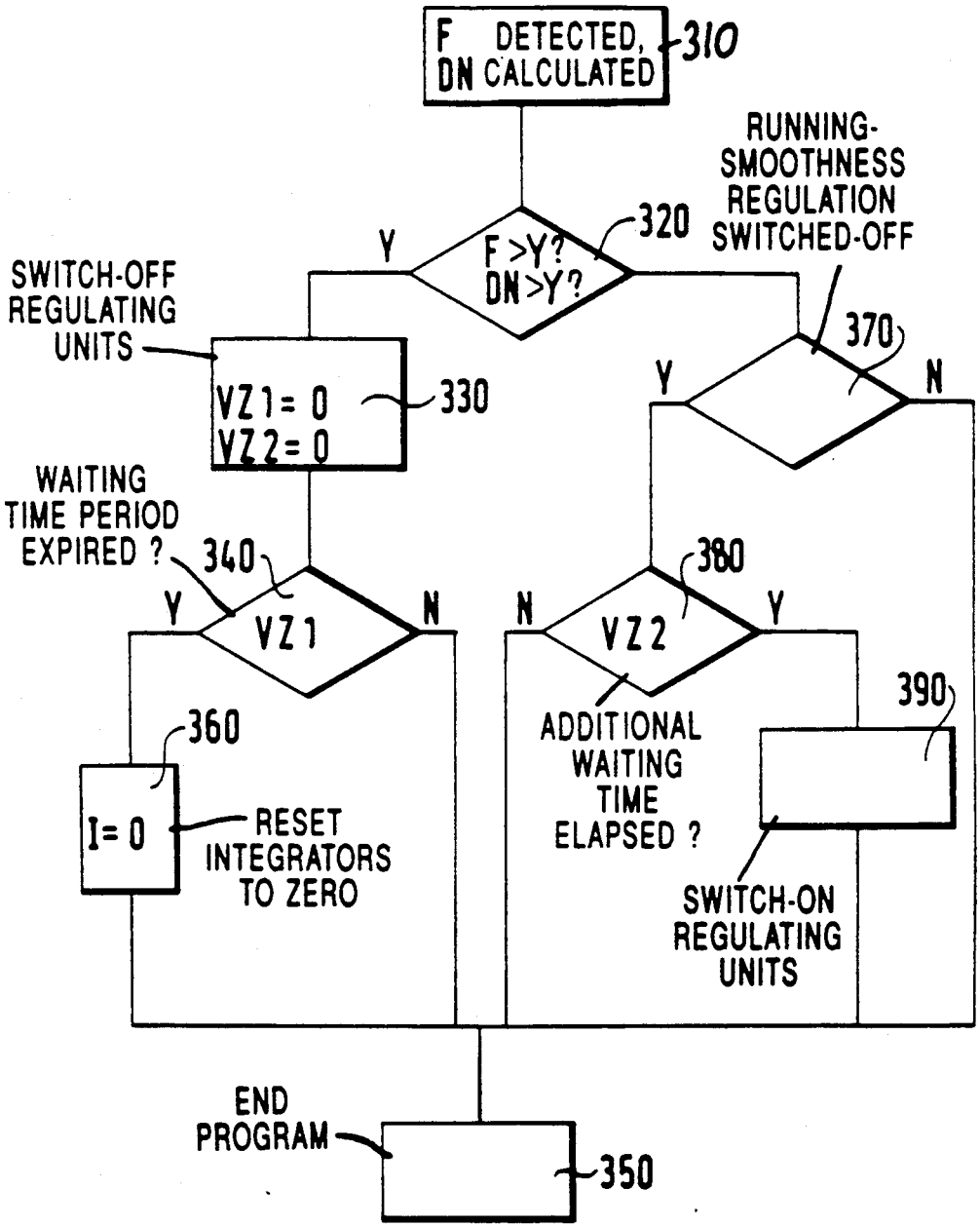
FIG. 3 is a flow chart illustrating conceptually the steps in accordance with the operation of the method and apparatus of the present invention.

In FIG. 3, a flow chart illustrates conceptually the steps in the operation of the method and apparatus of the present invention for overcoming the problems typically encountered in damping or eradicating such vibrations. In a first step 310, the vibrational frequency F is detected by the sensor 55. As also indicated in step 310, a system deviation DN can be calculated by the control unit 30 based on the vibrational frequency F. The system deviation DN is the difference between a setpoint value and the actual value of the vibrational frequency F. Then, in step 320 the control unit 30 determines whether the system deviation DN or the vibrational frequency F exceeds a threshold value, which is equal to the crankshaft frequency.

If the vibrational frequency F reaches the threshold value (Y) (i.e., if it is equal to or greater than the crankshaft frequency), then the control unit 30 switches off the running-smoothness regulating units 15, in step 330. Accordingly, the running-smoothness regulation is ceased, and only a running-smoothness control is then performed. At the same time, a first time meter VZ1 and a second time meter VZ2, which can be incorporated within the control unit 30 in a manner known to those of ordinary skill in the art, are initialized, as indicated in step 330. The control unit 30 then determines by means of the first time meter VZ1 whether a waiting time period has expired, as indicated in step 340. This time inquiry is performed to ensure that additional measures can be performed in the event that the vibrations above the threshold value persist for longer than the waiting period of time.

If the measurement of the vibrational frequency F reveals that during a number of crankshaft revolutions, or during the waiting time period only crankshaft frequencies occur, then additional measures are performed in step 360. Such measures can be, for example, increasing the idling speed of the engine 10, resetting the integrators I of the PI regulating units 15 equal to zero, as indicated in step 360, or cancelling the stored correction fuel quantities in the control unit 30. An increase in rotational speed within the range of about 50 to 100 revolutions per minute has proven to effectively remove the vibrations. Such an increase in rotational speed can typically cause the system frequency to change to a value outside of the resonant frequency range. Then, if the frequencies greater than or equal to the threshold value no longer occur, the idling speed is set to the preceding value.

If the control unit 30 determines that the vibrational frequency F, or the system deviation DN, respectively, is less than the threshold value in step 320, it then determines in step 370 whether or not the running-smoothness regulation had been previously switched off. If it is determined that the regulating units 15 are switched on (N) during step 370, then the program proceeds to step 350 and ends. If it is determined that the regulating units 15 are switched off (Y), however, it is then determined whether an additional waiting time VZ2 has elapsed in step 380. If the waiting time VZ2 has not yet expired (N), then the program continues with the regulating unit switched-off in step 350. If the waiting time VZ2 has expired (Y), then the regulating units 15 are again switched on in step 390.

Because of the additional waiting time as indicated by the second time meter VZ2, the problem of switching from the control operation back to the regulating operation too quickly is avoided. The switch from the control to the regulating operation is performed only upon the expiration of the waiting time VZ2, or after a number of speed pulses, after the system deviation DN or the vibrational frequency F, respectively, decreases to a value below the threshold value.

Figure 4A:
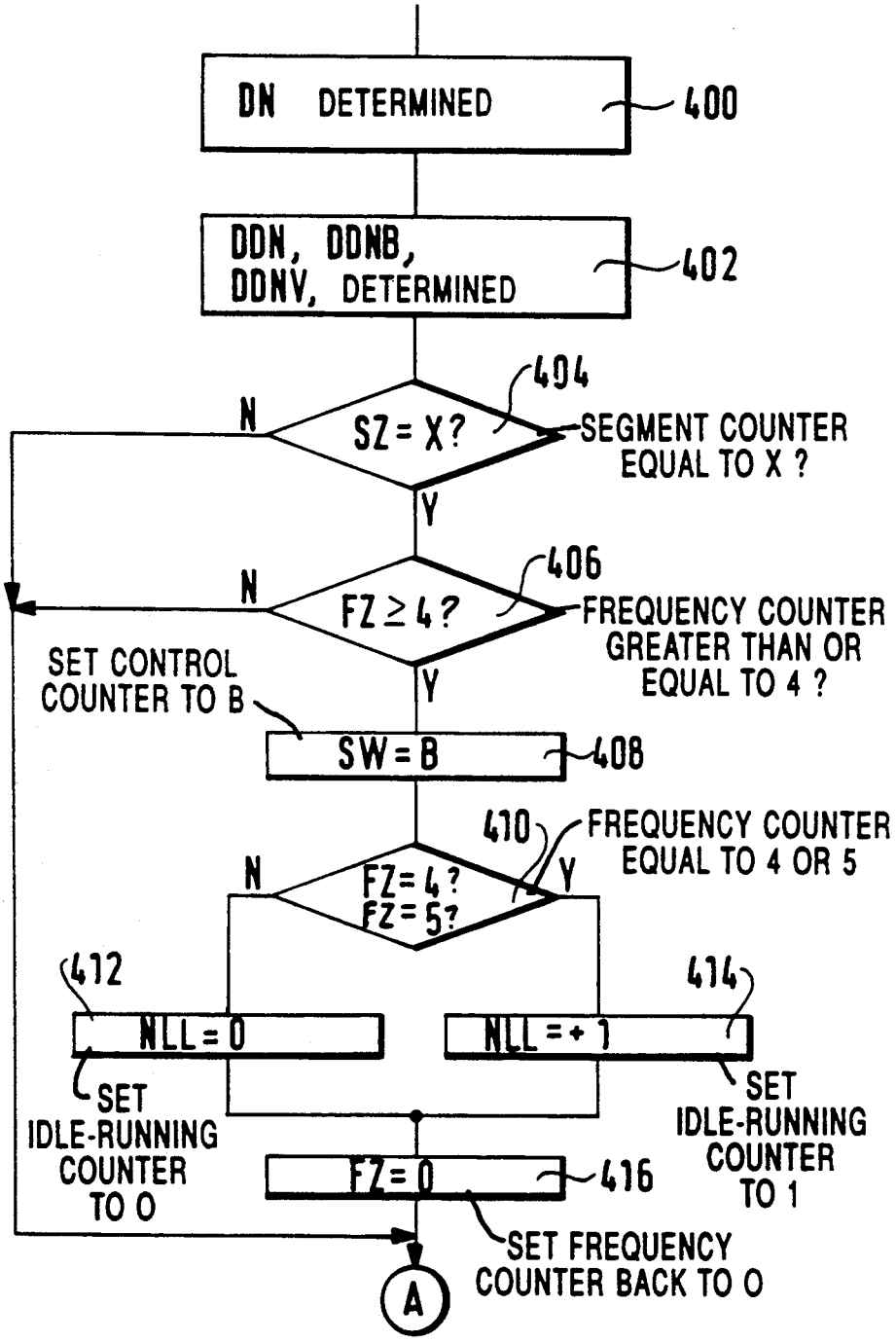
FIG. 4*a* is another flow chart illustrating conceptually the steps in accordance with the operation of the method and apparatus of the present invention.
Figure 4B:
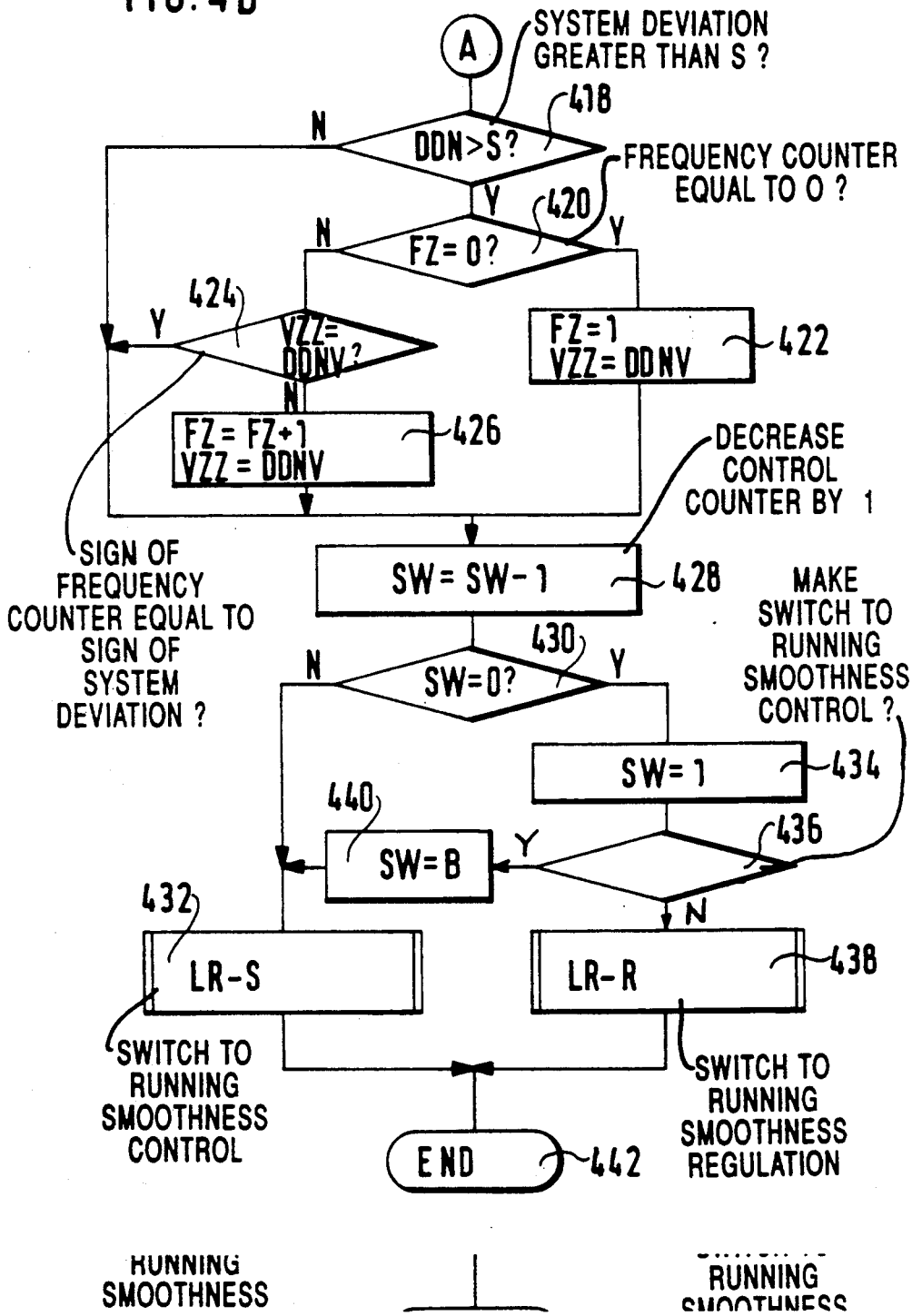
FIG. 4*b* is another flow chart illustrating conceptually the steps in accordance with the operation of the method and apparatus of the present invention.

In FIGS. 4*a* and 4*b*, flow charts conceptually illustrate the subroutine for the running-smoothness regulation in accordance with the operation of the method and apparatus of the present invention. The setpoint values for running smoothness and the actual values for running smoothness are first calculated by the control unit 30. The basis for performing this calculation is described in detail, for example, in German Published Patent application No. 33 36 028 (which corresponds to U.S. Pat. No. 4,688,535) or in German Published Patent application No. 36 04 904. Based on these values, the system deviation DN is then determined by the control unit 30, as indicated in step 400.

The change in the system deviation DDN is then determined by the control unit 30 from the actual, and from the preceding value of the system deviation DN, as indicated in step 402. Based on the change in system deviation DDN, its value DDNB and its sign DDNV (plus or minus) are determined by the control unit 30, as also indicated in step 402. It is then determined whether a segment counter SZ of the control unit 30 has reached a specific value X, as indicated in step 404. At a specific segment number, in the present example 2, the counting operation of a frequency counter FZ of the control unit 30 is started and, upon the next occurrence of the same segment number (2), it is stopped.

If the segment counter SZ has not yet reached a defined value X in step 404 (N), then the program jumps from step 404 to step 418 through point A, as indicated in FIGS. 4*a* and 4*b*. If it is determined that the segment counter SZ has reached the defined value X in step 404 (Y), then it means that two crankshaft revolutions have been completed. It is then determined if the frequency counter FZ is greater than or equal to 4, as indicated in step 406. If this is not the case (N), then the program jumps to step 418 through point A. If the frequency counter FZ assumes a value greater than or equal to 4 in step 406 (Y), then a control counter SW of the control unit 30 is set equal to B, as indicated in step 408.

It is then determined whether the frequency counter FZ has a value of 4 or 5, as indicated in step 410. If this is not the case (N), then an idle-running counter NLL of the control unit 30 is set equal to 0, as indicated in step 412. If, however, the frequency counter FZ does have a value of 4 or 5 (Y), then the idle-running counter NLL is set equal to 1, as indicated in step 414. Upon completing either step 412 or step 414, the frequency counter FZ is then set back to zero, as indicated in step 416.

The control unit 30 then checks to determine whether the change in system deviation DDN is greater than a threshold value S, as indicated in step 418 in FIG. 4*b*. If the change in system deviation DDN does not exceed the threshold value S in step 418 (N), then the program jumps to step 428. If it is determined that the change in system deviation DDN is greater than the threshold value S in step 418 (Y), it is then determined if the frequency counter FZ is set to 0 in step 420. If this is the case (Y), then the frequency counter FZ is set equal to 1 as indicated in step 422, and the sign of the frequency counter VZZ is set to be the same as the sign of the system deviation DDNV, as also indicated in step 422.

If the control unit 30 determines that the frequency counter FZ is not equal to 0 in step 420 (N), then it determines whether the sign of the frequency counter VZZ is the same as the sign of the system deviation DDNV in step 424. If the sign of the system deviation DDNV has not changed (Y), then the program jumps to step 428. If, on the other hand, the sign of the system deviation DDNV has changed (N), then the frequency counter FZ is increased by 1 and the sign of the frequency counter VZZ is set to be the same as the sign of the system deviation DDNV in step 426.

As indicated in FIG. 4*b*, step 428 can thus follow either of steps 422, 426 or 424, during which a control counter SW of the control unit 30 is decreased by 1. It is then determined whether the control counter SW is equal to 0 in step 430. If the control counter SW does not equal 0 (N), then the switch is made to running-smoothness control in step 432. If the control counter SW is determined to equal 0 in step 430 (Y), it is then set to 1 in step 434.

Upon completion of step 434, the control unit 30 then determines in step 436 if the switch to running-smoothness control should be made for other reasons. This is the case, for example, when the rotational speed is outside of the idling range of the engine. In this case, the control counter SW is set to B, as indicated in step 440. If, however, it is determined that there is no requirement for running-smoothness control during step 436, then the switch to running-smoothness regulation is made in step 438. Upon the completion of either of steps 432 or 438, the subroutine ends in step 442.

Figure 5:
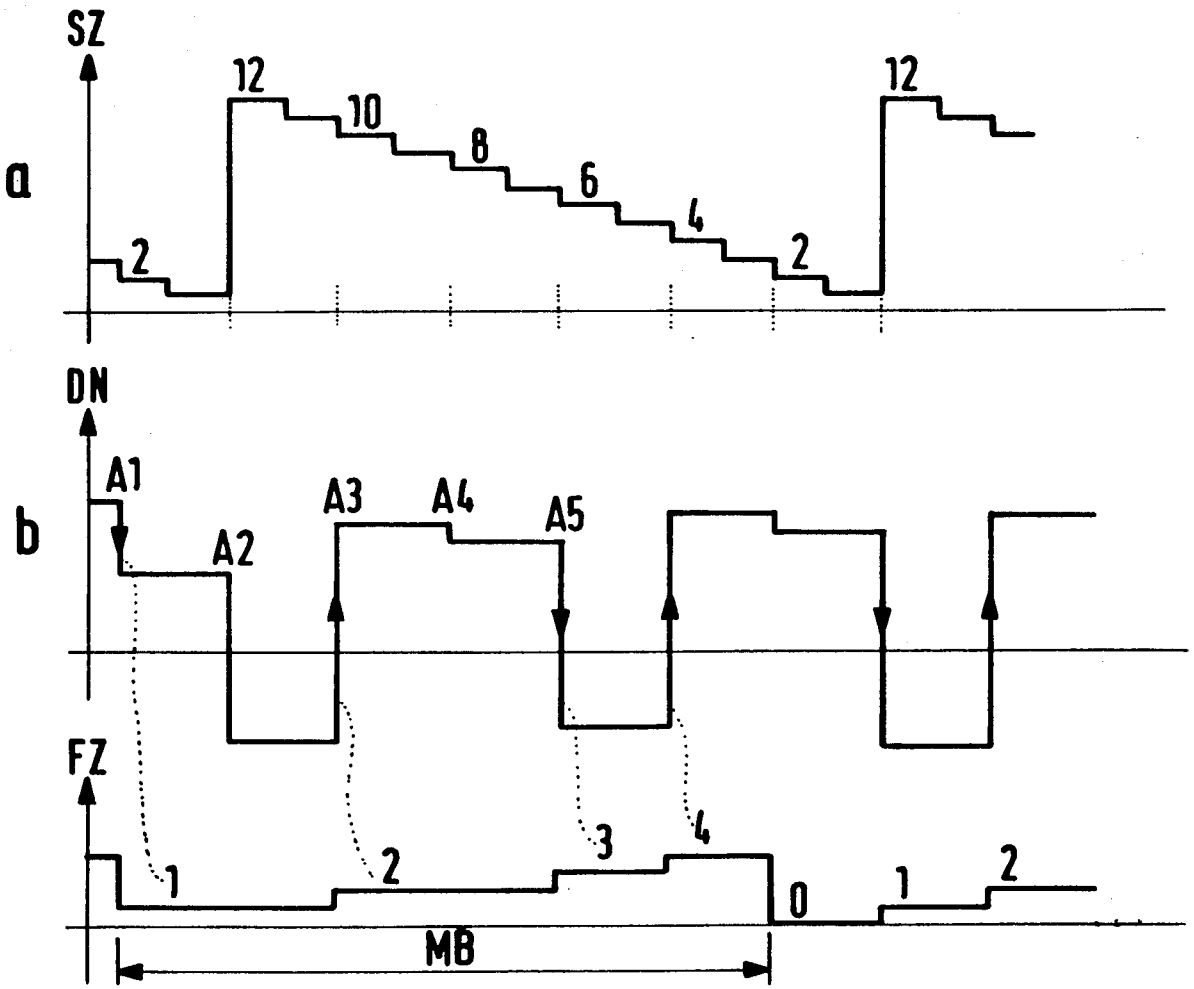
FIG. 5 includes several graphs (a–c) illustrating several signal patterns generated in the operation of the method and apparatus of the present invention.

In FIG. 5, several graphs (a–c) illustrate the various counter values (SZ and FZ) and the system deviation DN in accordance with the operation of the method and apparatus of the present invention. The values of the segment counter SZ are illustrated in FIG. 5*a*. A measuring range MB is established based on this counting operation, as indicated in FIGS. 5*a* and 5*c*. The measuring range MB begins at a predetermined value of the segment counter SZ which, in the example illustrated, is 2. The measuring range MB ends when the segment counter SZ again assumes a value of 2.

The illustrated example is for an internal combustion engine 10 including six cylinders and, thus, the segment counter SZ runs from the value 12 to the value 1, as illustrated in FIG. 5*a*. The segment counter SZ counts the signals transmitted by the sensor 40 in response to the pulses generated by the segmented wheel 50 mounted on the crankshaft, as described above. In this example, each counting operation runs for two revolutions of the crankshaft. Thus, 12 pulses are transmitted over two crankshaft revolutions.

The system deviation DN is plotted in FIG. 5*b*. Changes in the system deviation DN which, in turn, cause the frequency counter FZ to be increased, are marked with arrows. Upon every change in the system deviation DN which fulfills the appropriate conditions, the frequency counter FZ is increased by 1, as illustrated in FIGS. 5*b* and 5*c*, as hereinafter described.

The frequency counter FZ is increased only when the system deviation DN exceeds a threshold value and when the sign of the system deviation changes at the same time. At the variation Al in the system deviation DN, both conditions are fulfilled and, therefore, the frequency counter FZ is increased by one, as illustrated in FIGS. 5*b* and 5*c*. At the variation A2, the system deviation changes by a specific amount, however, because its sign does not change, the frequency counter FZ maintains its value (1). Then, at the variation A3, both the system deviation and its sign changes and, thus, the frequency counter FZ is increased by 1 to a value of 2.

A particular advantage of the method and apparatus of the present invention is that the running-smoothness regulation is activated only when the disturbances giving rise to the additional vibrations have ceased. Such disturbances can be caused, for example, by the resonant vibrations of a dual-mass flywheel, or by the operation of a gas pedal or clutch pedal when the transmission changes gears. When these types of disturbances are recognized, a switch is immediately made from regulation to control. Thus, any potential unbalances in the integrators can be avoided.

We claim:

1. A method for regulating and controlling the smooth operation of an internal combustion engine comprising the following steps:

performing a running-smoothness regulation by regulating the flow of fuel to the cylinders of the internal combustion engine to achieve smooth engine operating conditions;

sensing the vibrational frequency of the engine and generating output signals indicative thereof; and comparing the output signals to a threshold value, and if the output signals exceed the threshold value, ceasing the running-smoothness regulation.

2. A method as defined in claim 1, further comprising the following steps:

upon ceasing the running-smoothness regulation, continuing to generate the output signals and to compare the output signals to the threshold value, and if the output signals fall below the threshold value, initiating a waiting period, and upon the expiration of the waiting period, initiating the running-smoothness regulation.

3. A method as defined in claim 1, wherein the vibrational frequency values are converted into corresponding system deviation values and thus the output signals generated are indicative thereof.

4. A method as defined in claim 3, wherein the system deviation values are detected by means of a frequency counter.

5. A method as defined in claim 4, wherein the frequency counter is increased in response to the system deviation value simultaneously changing its sign and exceeding a threshold value.

6. A method as defined in claim 1, further comprising the following steps:

upon ceasing the running-smoothness regulation, initiating a waiting time period and continuing to generate the output signals and to compare the output signals to the threshold value, and if upon the expiration of the waiting time period the output signals continue to exceed the threshold value, performing an additional step selected from the group including a) increasing the engine idling speed, b) setting the integrator of a regulating unit equal to zero, and c) cancelling the stored correction fuel quantities of a regulating unit.

7. A method as defined in claim 6, wherein the engine idling speed is increased within the range of 50 to 100 revolutions per minute.

8. A method as defined in claim 1, further comprising the following steps:

determining a correction fuel quantity for each cylinder of the engine during the running-smoothness regulation, storing the correction fuel quantities, and adding each correction fuel quantity to a corresponding basic fuel quantity for each respective cylinder to determine new basic fuel quantities and, in turn, controlling the flow of fuel to the cylinders in accordance with the respective new basic fuel quantities.

9. An apparatus for regulating and controlling the smooth operation of an internal combustion engine, comprising:

at least one regulating unit for performing a running-smoothness regulation by regulating the flow of fuel to the cylinders of the internal combustion engine to achieve smooth engine operating conditions;

means for sensing the vibrational frequency of the engine and generating output signals indicative thereof; and a control unit coupled to the regulating unit and to the means for receiving the output signals therefrom, the control unit being adapted to compare the output signals to a threshold value, and if the output signals exceed the threshold value, to control the regulating unit to cease the running-smoothness regulation.

10. An apparatus as defined in claim 9, wherein the means for sensing is adapted to continue to generate output signals and the control unit is adapted to continue to compare the output signals to the threshold value upon ceasing the running-smoothness regulation, and if the output signals drop below the threshold value, the control unit is further adapted to initiate a waiting period and upon expiration of the waiting period to, in turn, control the regulating unit to initiate the running-smoothness regulation.

11. An apparatus as defined in claim 9, wherein the control unit is adapted to convert the output signals transmitted by the means for sensing into corresponding signals indicative of system deviation values, the system deviation values being based on the difference between the instantaneous vibrational frequency of the engine sensed by the means for sensing and a setpoint value.

12. An apparatus as defined in claim 11, wherein the setpoint value is equal to the vibrational frequency of the crankshaft of the engine.

13. An apparatus as defined in claim 11, wherein the control unit includes a frequency counter adapted to generate the system deviation values.

14. An apparatus as defined in claim 13, wherein the frequency counter is increased in response to the system deviation value simultaneously changing its sign and exceeding a threshold value.

15. An apparatus as defined in claim 9, wherein the means for sensing is adapted to continue to generate output signals and the control unit is adapted to initiate a waiting time period and to continue to compare the output signals to the threshold value upon ceasing the running-smoothness regulation, and if upon the expiration of the waiting time period the output signals continue to exceed the threshold value, the control unit is further adapted to cause an increase in the engine idling speed.

16. An apparatus as defined in claim 15, wherein the control unit causes the engine idling speed to increase within the range of 50 to 100 revolutions per minute.

17. An apparatus as defined in claim 9, wherein the regulating unit is adapted to determine a correction fuel quantity for at least one cylinder of the engine and to transmit signals to the control unit indicative thereof, the control unit being adapted to store the signals in response thereto and, in turn, add the value of each correction fuel quantity to a basic fuel quantity for a respective cylinder to determine a new fuel quantity therefor, the control unit being further adapted to control the flow of fuel to a respective cylinder in accordance with the new fuel quantity therefor.

18. A method of regulating and controlling the smooth operation of an internal combustion engine comprising the following steps:

performing a running -smoothness regulation by controlling the flow of fuel to the cylinders of the internal combustion engine for smoothing engine operating conditions;

determining the vibrational frequency of the engine and generating output signals indicative of the vibrational frequency;

comparing the output signals to a threshold value, and if the output signals exceed the threshold value, ceasing the running-smoothness regulation; and after ceasing the running-smoothness regulation, continuing to generate the output signals and to compare the output signals to the threshold value, and if the output signals fall below the threshold value, initiating a waiting period in which the running-smoothness regulation is not performed, and upon the expiration of the waiting period, reinitiating the running-smoothness regulation.

19. A method as defined in claimed 18, wherein the vibrational frequency values are converted into corresponding system diviation values and the output signals generated are indicative of the corresponding system diviation values.

20. A method as defined in claim 19, wherein the system deviation values are detected by means of a frequency counter.

21. A method as defined in claim 20, wherein the frequency counter if increased in response to the system deviation value simultaneously changing its sign and exceeding a threshold value.

* * * * *